US005675319A

United States Patent [19]

Rivenberg et al.

[11] Patent Number: 5,675,319

[45] Date of Patent: Oct. 7, 1997

[54] TAMPER DETECTION DEVICE

[75] Inventors: Howard Christopher Rivenberg; Aaron William Levine; Nitin Vithalbhai Desai, all of Mercer, N.J.

[73] Assignee: David Sarnoff Research Center, Inc., Princeton, N.J.

[21] Appl. No.: 638,257

[22] Filed: Apr. 26, 1996

[51] Int. Cl.[6] ..... G08B 13/06; G08B 13/10; G08B 13/22

[52] U.S. Cl. ..... 340/550; 340/540; 340/541; 340/562; 340/652

[58] Field of Search ..... 340/550, 562, 340/541, 652, 540

[56] References Cited

U.S. PATENT DOCUMENTS 5,506,566 4/1996 Oldfield et al. ..... 340/550

*Primary Examiner*—Glen Swann

*Attorney, Agent, or Firm*—William J. Burke

[57] ABSTRACT

A tamper detection device can determine whether a housing containing a device has been tampered with either by having the housing penetrated or by an attempt to remove a cover from the housing. The tamper detection device may be a capacitor which is placed across a portion of the housing and whose capacitance changes if it is penetrated. The temper detection device may also be a flexible circuit having conductive strips thereon forming a circuit with means to cause an open circuit if the housing is penetrated or the cover removed from the housing.

9 Claims, 4 Drawing Sheets

TAMPER DETECTION DEVICE

STATEMENT OF GOVERNMENT INTEREST

This invention was made with Government support under MDA904-94-C-6054 awarded by Maryland Procurement Office. The Government has certain rights in this invention.

FIELD OF THE INVENTION

The invention relates to a tamper detection device for a housing, and, more particularly, to a tamper detection circuit which is placed between the parts of a housing to detect whether the housing has been tampered with.

BACKGROUND OF THE INVENTION

Electronic devices are generally enclosed in a housing of some type to protect the device from contaminants in the atmosphere, temperature, humidity and from being damaged during handling. The housing may have a cover extending over a printed circuit board on which the device is formed or comprise a multi-part housing surrounding the device. There are times when the housing may be tampered with, either accidentally or intentionally. If the housing is tampered with by either being penetrated or by being opened, the electronics in the housing may be damaged. Therefore, it would be desirable to provide a responsive housing with means to determine whether the housing has been tampered with. This would permit a variety of verification techniques to determine whether the electronics have been accessed because of the tampering with the housing.

SUMMARY OF THE INVENTION

A housing for a device includes at least a cover extending over the device. Under the cover is an electrical device whose electrical characteristics are changed if the cover is tampered with either by being penetrated or by being removed. The electrical device may be a capacitor extending across the cover, the capacitance of which will vary if penetrated, and/or may be an electrical circuit whose characteristics are changed if the cover is removed.

BRIEF DESCRIPTION OF THE DRAWING

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
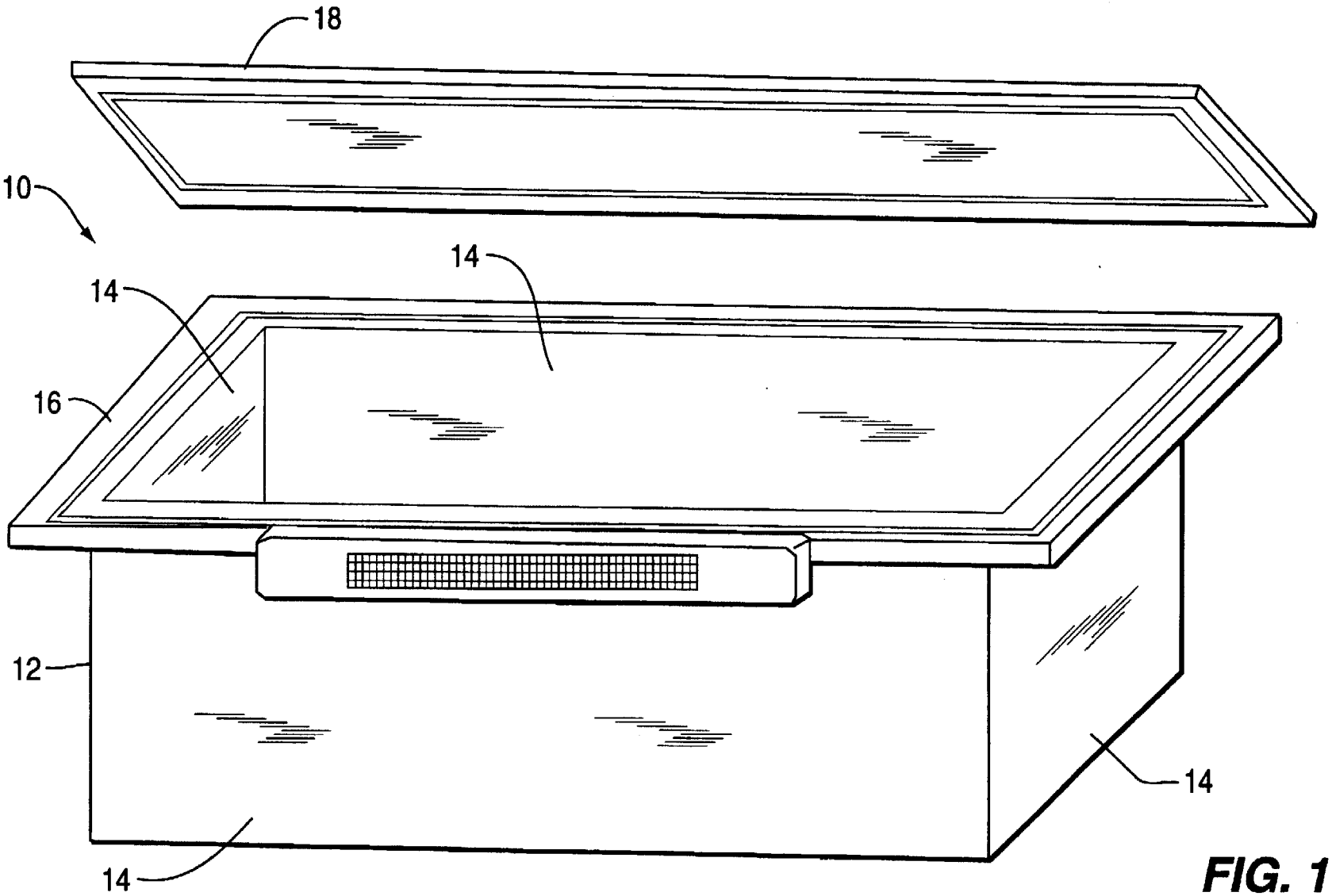
FIG. 1 is a perspective view of a housing for an electrical device with which the tamper detection device of the invention may be used.

Referring initially to FIG. 1, a housing with which the tamper detection device of the invention can be used is generally designated as 10. Housing 10 has a bottom portion 12 which comprises a bottom wall, not shown, upright side walls 14 extending from the bottom wall and a ledge 16 extending outwardly from the top edge of the side walls. The bottom portion 12 is adapted to contain the device to be protected by the housing 10. The housing 10 also includes a cover 18, preferably substantially flat, which is of a size and shaped to extend over the open side of the bottom portion 12 and rest on the ledge 16. The cover 18 may be secured to the ledge 16 of the bottom portion 12 by any suitable means so as to completely enclose the device to be protected within the housing 10.

Figure 2:
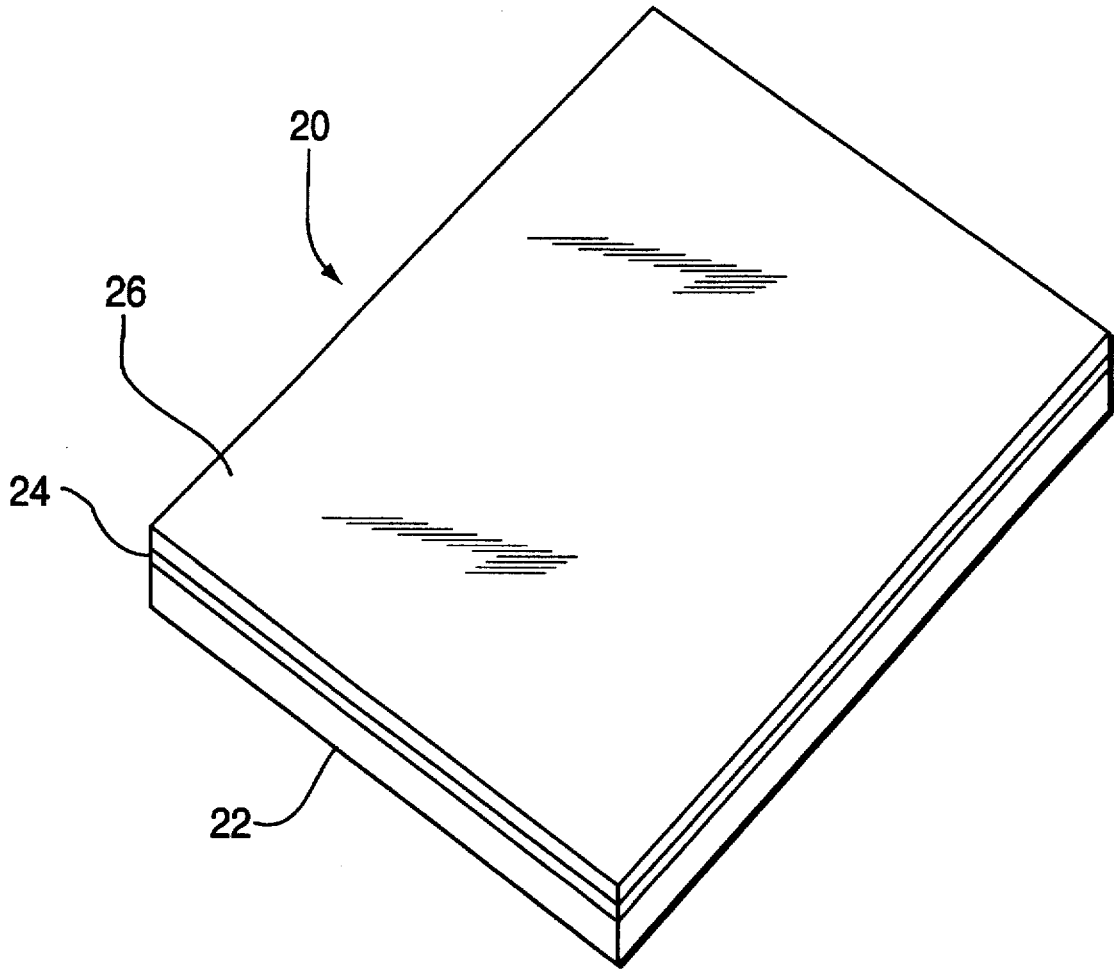
FIG. 2 is a perspective view of a capacitor which can be used in the housing of FIG. 1 to determine whether the cover of the housing is penetrated.

Referring to FIG. 2 there is shown one form of a tamper detection device of the invention which is in the form of a capacitor 20. Capacitor 20 comprises a plate 22 of an electrically conductive material which serves as one electrode of the capacitor 20. A layer 24 of a dielectric material covers at least one side of the electrode plate 22. A layer 26 of an electrically conductive material is over the dielectric layer 24 and serves as the other electrode of the capacitor 20.

The materials of the capacitor 20 are such that if the capacitor 20 is penetrated, the electrical characteristics of the capacitor 20 will change. For example, the electrode plate 22 is preferably made of a metal which can be readily oxidized, such as aluminum. The dielectric layer 24 is preferably of aluminum oxide which is formed by anodizing the plate 22. The conductive layer 26 is preferably of $MnO_2$ dispersed in a polyimide precursor binder. The conductive layer 26 may be applied to the dielectric layer 24 by brushing, spraying or other suitable coating technique. The $MnO_2$ acts as a conductor for normal operation of the capacitor 20.

The capacitor 20 is placed across the inner surface of the cover 18 of the housing 10 and over the open side of the bottom portion 12. The capacitor 20 may also be placed across the inner surfaces of the side walls 14. The plates 22 and 26 of the capacitor 20 are connected across a source of current and to some type of detection and alarm system. If the cover 18 or side walls 14 of the housing 10 are penetrated, the capacitor 20 will also be penetrated. The penetration of the plates 22 and 26 and/or the dielectric layer 24 of the capacitor 20 will cause the capacitance of the capacitor 20 to change. This change in the capacitance of the capacitor 20 will be detected by the detection and alarm system which will provide an indication that the housing 10 has been tampered with by being penetrated.

Figure 3:
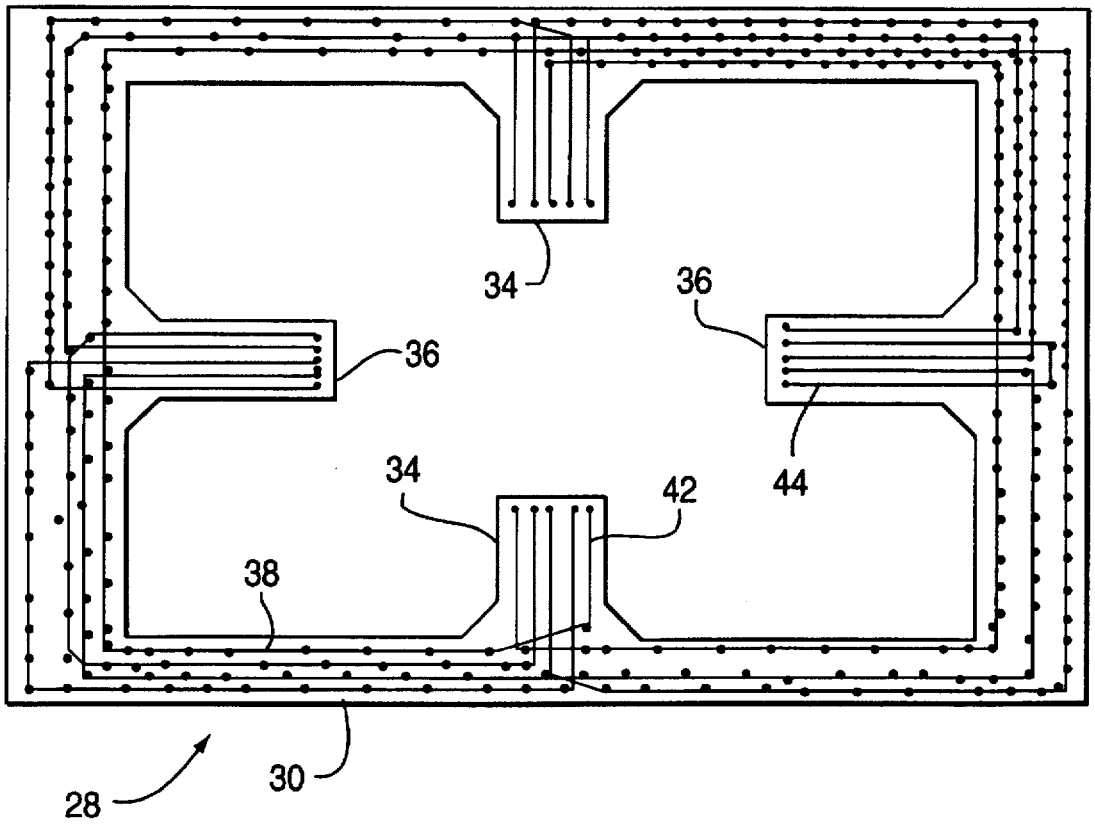
FIG. 3 is a top view of a flexible circuit which can be used in the housing of FIG. 1 to determine whether the cover of the housing has been removed.
Figure 4:
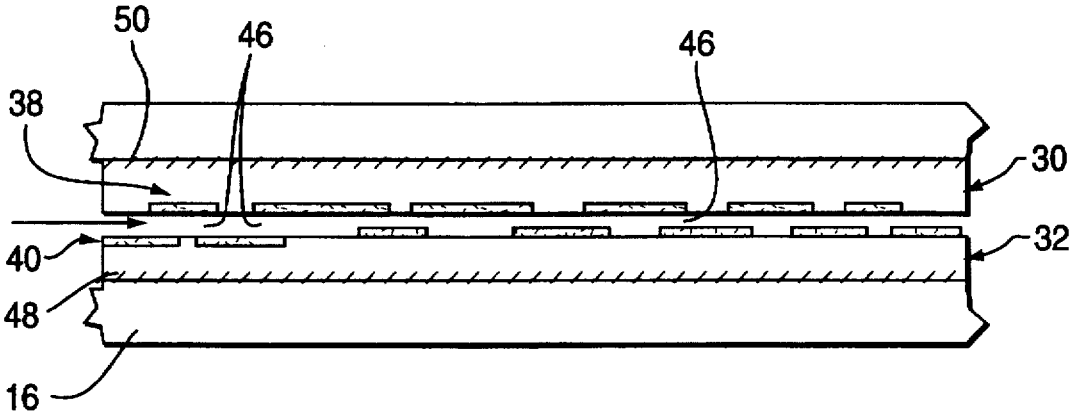
FIG. 4 is a sectional view of the flexible circuit of FIG. 3 mounted in a housing.

Referring to FIGS. 3 and 4, a flexible circuit in accordance with the invention is generally designated as 28. Flexible circuit 28 comprises two sheets 30 and 32 of a flexible insulating material, such as a plastic. Each sheet 30 and 32 is of a shape and size corresponding to the ledge 16 of the bottom portion 12 of the housing 10. As shown, the sheets 30 and 32 are rectangular with a separate arm 34 and 36 respectively extending inwardly from each side thereof. On one surface of each of the sheets 30 and 32 is a pattern of conductive strips 38 and 40 respectively. The conductive strips 38 and 40 can be in any desired pattern which extend completely around the sheets 30 and 32. As shown, the conductive strips 38 and 40 are in the pattern of four separate lines extending around the sheets 30 and 32. Conductive connecting strips 42 and 44 extend along the arms 34 and 36. Each of the lines of the conductive strips 38 and 40 is connected to a line of each of the lines of the connecting strips 42 and 44 to form circuits around the sheets 30 and 32.

The lines of the connecting strips 42 and 44 may be connected together to form either a single circuit or a plurality of separate circuits around the sheets 30 and 32. The conductive strips 38, 40, 42 and 44 may be formed either by coating a conductive material on the surfaces of the sheets 30 and 32 in the desired pattern, such as by brushing or silk screening, or by bonding a layer of a conductive material to each of the sheets 30 and 32 and defining the conductive strips by etching the layer of conductive material.

As shown in FIG. 4, the two sheets 30 and 32 are positioned with the patterns of conductive strips 38, 40, 42 and 44 facing each other but in slightly spaced relation. Between the conductive strips 38 and 42 on the sheet 30 and the conductive strips 40 and 44 on the sheet 32 are a plurality of conductive interconnects 46. The interconnects 46 are positioned along the conductive strips 38, 40, 42 and 44 at a plurality of spaced points as shown by the dots in FIG. 3. Each of the interconnects 46 is a bump of an adhesive material containing particles of a conductive material so as to be conductive. The adhesive material may be a polymer and the conductive particles may be of silver, carbon, copper or nickel. The interconnect bumps 46 may be applied to the conductive strips on one of the sheets 30 and 32 by silk screening. Each interconnect bump 46 is of sufficient thickness to space the two sheets 30 and 32 from each other. Once the interconnect bumps 46 are applied to strips on one of the sheets, the other sheet is positioned over the one sheet with its strips contacting the bumps 46. The polymer in the interconnect bumps 46 is then cured to secure the two sheets 30 and 32 together in slightly spaced relation.

After the two sheets 30 and 32 are bonded together through the interconnect bumps 46, the flexible circuit 28 is placed on the ledge 16 of the bottom portion 12 of the housing 10 as shown in FIG. 4, with one of the sheets, such as the sheet 32, being seated on the ledge 16. A layer 48 of a strong adhesive is provided between the sheet 32 and the ledge 16 to secure the flexible circuit 28 to the ledge 16. After the device is placed in the bottom portion 12 of the housing 10, the cover 18 is placed over the ledge 16 and seated on the sheet 30 of the flexible circuit 28. A layer 50 of a strong adhesive is provided between the cover 18 and the sheet 30 to secure the cover to the flexible circuit 28 and to the bottom portion 12 of the housing 10.

In the device, the conductive strips 38 and 40 are electrically connected together in a circuit or a plurality of circuits through the interconnect bumps 46 and the connecting strips 42 and 44. The circuit or circuits formed by the conductive strips 38 and 40 are connected to a detector and alarm system either in the housing 10 or external of the housing 10. Thus, if the circuit or circuits are broken, it will be detected by the detector which will operate the alarm. If the cover 18 is removed from the housing 10, the interconnect bumps 46 will be broken to break the circuit or circuits and provide a suitable alarm. The interconnect bumps 46 are so positioned along the conductive strips 38 and 40 that if someone attempted to insert an instrument, such as a screw driver, between the ledge 16 on the bottom portion 12 of the housing 10 and the cover 18, at least one of the interconnect bumps 46 will be broken to break a circuit and provide an alarm. Thus, the flexible circuit 28 provides for detecting any attempt to tamper with the housing 10 and provide a suitable alarm.

Figure 5:
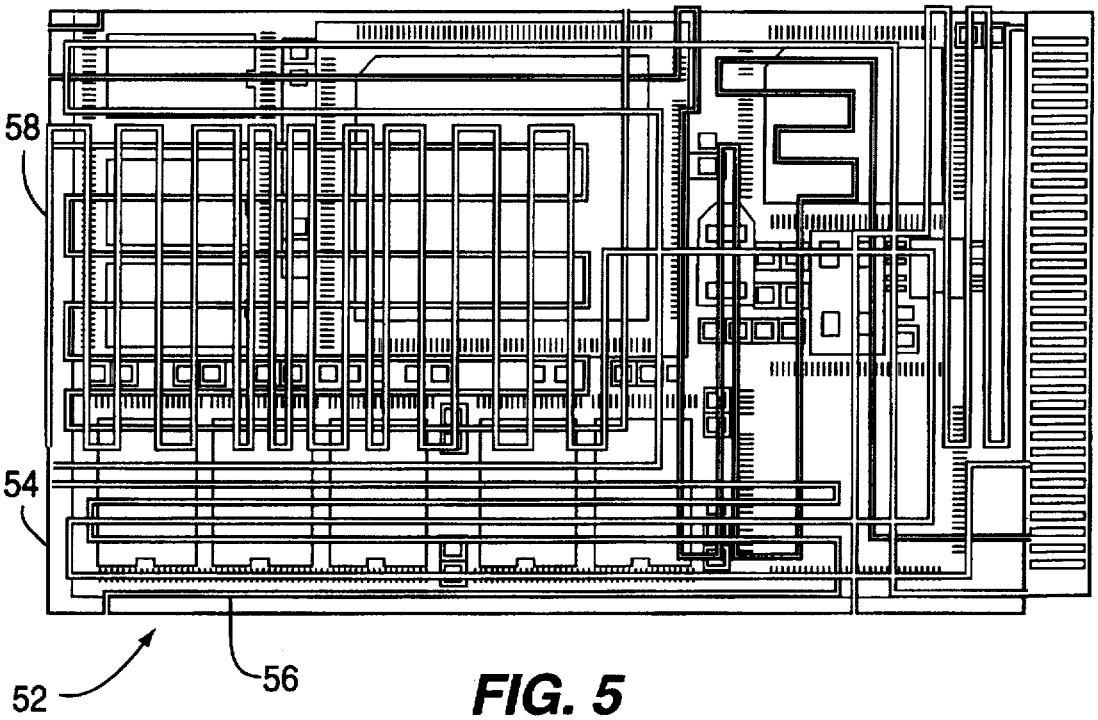
FIG. 5 is a top view of another form of a flexible circuit which can be used to determine whether the cover of the housing has been penetrated.

Referring now to FIG. 5, another form of the flexible circuit of the invention which can be used to determine whether a cover has been penetrated is generally designated as 52. Flexible circuit 52 comprises a sheet 54 of a flexible insulating material, such as a plastic, of a shape and size corresponding to the open side of a housing. The sheet 54 is larger than the open side of the housing so that a portion of the edges of the sheet 54 can be folded down along the sides of the housing. On the sheet 54 are a plurality of strips 56 and 58 of a conductive material, such as a metal. The conductive strips 56 and 58 may be formed on opposite sides of the sheet 54 or on one side with a layer of an insulating material therebetween. Although the flexible circuit 52 is shown as having two conductive strips 56 and 58 thereon, it may have any desired number of the strips. Each of the strips 56 and 58 is arranged in a meandering path across the surface of the sheet 54 and cross each other in a number of places so that the strips cover a substantial portion of the surface of the sheet 54.

Figure 6:
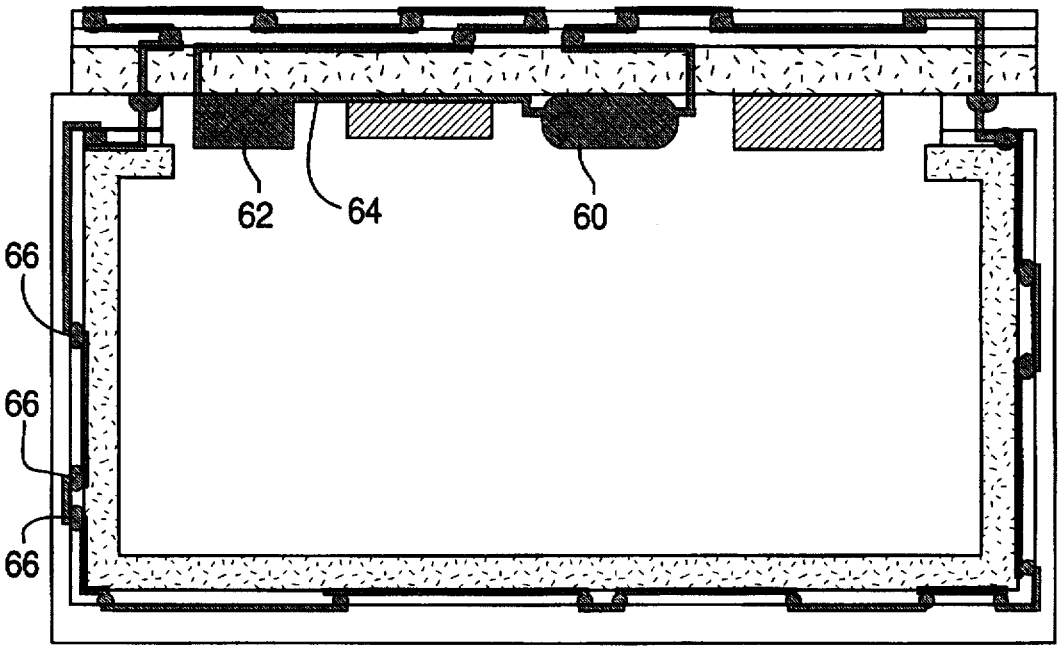
FIG. 6 is a top view showing the manner of connecting the flexible circuit of FIG. 5 to a detector means.

In the use of the flexible circuit 52, the sheet 54 is placed over the open side of a housing with the cover of the housing being placed over the sheet 54. The edges of the sheet 54 are folded along the sides of the housing. As shown in FIG. 6, the housing 10 may contain a circuit which includes a battery 60, an alarm 62 and a circuit pattern 64 electrically connecting the alarm 62 and the battery 60. The portions of the strips 56 and 58 on the edge portions of the sheet 54 are electrically connected to the circuit pattern 64 by conductive interconnections 66 so that the strips 56 and 58 are electrically connected in the circuit containing the battery 60 and the alarm 62. Thus, if someone attempts to penetrate the cover, at least one of the strips 56 and 58 will be broken so as to break the circuit in which the strips 56 and 58 are connected. This will cause the alarm 62 to indicate that the circuit is broken and an attempt to penetrate the housing has occurred.

Thus, there is provided by the invention a device for mounting on a housing to provide means to indicate whether the housing has been tampered with either by having the cover of the housing penetrated or removed. The tamper detection means includes an electrical device whose electrical characteristics change if it is tampered with. The device can be a capacitor whose capacitance changes if penetrated, or a flexible circuit having a plurality of conductive strips thereon which will provide an open circuit if the housing is tampered with. It is to be understood that the apparatus and method of operation taught herein are illustrative of the invention. Modifications may readily be devised by those skilled in the art without departing from the spirit or scope of the invention.

We claim:

1. A housing for a device comprising:

a bottom portion for containing the device and having an open side;

a cover extending over the open side of the bottom portion and secured to the bottom portion; and a capacitor extending across the open side of the bottom portion and under the cover, said capacitor having electrical characteristics which change if the cover is tampered with by being penetrated and/or removed.

2. The housing of claim 1 in which the capacitor comprises a flexible metal sheet having a dielectric coating over one surface and a conductive layer over the dielectric layer.

3. The housing of claim 2 in which the dielectric coating is an oxide of the metal sheet, and the conductive layer is particles of a conductive material in a plastic binder.

4. A housing for a device comprising:

a bottom portion for containing the device and having an open side;

a cover extending over the open side of the bottom portion and secured to the bottom portion; and electrical means between the cover and the bottom portion and secured to the bottom portion having electrical characteristics which change if the cover is tampered with by being penetrated and/or removed, wherein the electrical means comprises:

two sheets of a flexible plastic with each sheet having thereon a pattern of conductive strips, said sheets overlapping each other with the conductive strips facing each other but slightly spaced apart, and conductive interconnects extending between various points on the conductive strips on the sheets to electrically connect the conductive strips on the two sheets.

5. The housing of claim 4 in which the interconnects are bumps of a conductive material in a bonding material so that the bumps secure the sheets together in spaced relation and electrically connect the conductive strips on the two sheets.

6. The housing of claim 5 in which the flexible circuit extends between mating portions of the bottom portion and the cover with one sheet being bonded to the bottom portion and the other sheet being bonded to the cover.

7. The housing of claim 6 in which the sheets are bonded to their respective bottom portion and cover by a bonding means which is stronger than the bonding material of the bumps.

8. A housing for a device comprising:

a bottom portion for containing the device and having side walls and an open side;

a cover extending over the open side of the bottom portion and secured to the side walls of the bottom portion;

a flexible circuit having a pattern of conductive strips on a flexible sheet of plastic, said flexible circuit extending across the open side of the bottom portion, under the cover and across the side walls of the bottom portion, the conductive strips extending in a pattern which covers a large portion of the flexible sheet so that the electrical characteristics of the flexible circuit will change if the cover is tampered with by being penetrated and/or removed.

9. The housing of claim 8 in which the conductive strips are on both sides of the flexible sheet.

* * * * *